US006163306A

United States Patent [19]

Nakamura et al.

[11] Patent Number: 6,163,306

[45] Date of Patent: Dec. 19, 2000

[54] CIRCULARLY POLARIZED CROSS DIPOLE ANTENNA

[75] Inventors: Takashi Nakamura, Gifu; Koji Nishida, Tokyo, both of Japan

[73] Assignee: Harada Industry Co., Ltd., Japan

[21] Appl. No.: 09/309,773

[22] Filed: May 11, 1999

[30] Foreign Application Priority Data

May 12, 1998 [JP] Japan ..... 10-129010

[51] Int. Cl.[7] ..... H01Q 21/26

[52] U.S. Cl. ..... 343/797; 343/795; 343/700 MS

[58] Field of Search ..... 343/797, 795, 343/700 MS, 793, 803, 798, 806, 810, 816, 820, 821, 822; H01Q 21/26, 9/28

[56] References Cited

U.S. PATENT DOCUMENTS 4,062,019 12/1977 Woodward et al. ..... 343/797

4,403,222 9/1983 Bitter, Jr. et al. ..... 343/833

*Primary Examiner*—Hoanganh Le

*Attorney, Agent, or Firm*—Pennie & Edmonds LLP

[57] ABSTRACT

A circularly polarized cross dipole antenna according to the present invention comprises a first L-shaped dipole antenna element including a first pair of strip conductors and a first bending portion and a second L-shaped dipole antenna element including a second pair of strip conductors and a second bending portion. The first L-shaped dipole antenna element is arranged in a first region of four regions delimited by crossing lines virtually set within a single plane and the second L-shaped dipole antenna element is arranged in a second region thereof which is diagonally opposite to the first region. The first bending portion and the second bending portion are close and opposite to each other such that the first and second L-shaped dipole antenna elements form a cross. The antenna also comprises a parallel-twin-line feeder extended from the first and second bending portions and provided so as to feed power within the single plane.

6 Claims, 3 Drawing Sheets

CIRCULARLY POLARIZED CROSS DIPOLE ANTENNA

BACKGROUND OF THE INVENTION

The present invention relates to a circularly polarized cross dipole antenna favorably used as a circularly polarized antenna for communications.

There is Jpn. Pat. Appln. KOKAI Publication No. 04-291806 as a document showing a prior art technique of the circularly polarized cross dipole antenna. This Publication discloses a circularly polarized (cross dipole) antenna for communications which is constituted of a cross dipole antenna element and a reflector.

FIG. 7 is a perspective view schematically showing an example of a prior art circularly polarized cross dipole antenna corresponding to that of the above Publication. The antenna shown in FIG. 7 includes a reflector 110, a pair of L-shaped dipole antenna elements 111 and 112, a parasitic loop 113, and a feeder 114.

The L-shaped dipole antenna elements 111 and 112 are arranged to cross each other and supplied with power through the feeder 114 to radiate a circularly polarized radio wave in the main radiating direction indicated by solid-line arrow M and in its opposite direction indicated by broken-line arrow N. The reflector 110 is disposed at a given distance from the paired L-shaped dipole antenna elements 111 and 112, and reflects the radio wave radiated from the antenna elements 111 and 112 in the opposite direction N and combines it with the radio wave radiated therefrom in the main radiating direction M into a composite wave. The parasitic loop 113 is a metal loop disposed within the same plane as the antenna elements 111 and 112 and has a function of guiding the composite wave in the main radiating direction M.

The foregoing prior art circularly polarized cross dipole antenna has the following problems.

The feeder 114 is constituted of a pair of conductors. One end of each of the conductors is connected to its corresponding bending portion of the antenna elements 111 and 112, and the other ends thereof extend in the direction of the reflector 110, or in the direction perpendicular to the plane including the antenna elements 111 and 112. Since the prior art antenna is constituted three-dimensionally, various problems arise in mounting the antenna on a circuit board.

Since, more specifically, the prior art antenna is difficult to mount on a circuit board compactly because of its three-dimensional structure, it is poor in workability when it is mounted on the circuit board together with a balun (a matching transformer for transforming a balanced line and an unbalanced line) and a matching circuit, and the number of assembling steps is increased. Since, furthermore, the prior art antenna is increased in volume, it is disadvantageous for its transportation and transportation costs.

BRIEF SUMMARY OF THE INVENTION

It is accordingly an object of the present invention to provide a circularly polarized cross dipole antenna which can be mounted on a circuit board compactly and has considerably good antenna characteristics.

In order to attain the above object, the circularly polarized cross dipole antenna according to the present invention has the following features in constitution. The other features will be clarified later in the Description of the Invention.

According to one aspect of the present invention, there is provided a circularly polarized cross dipole antenna comprising:

a first L-shaped dipole antenna element including a first pair of strip conductors and a first bending portion, and a second L-shaped dipole antenna element including a second pair of strip conductors and a second bending portion, the first L-shaped dipole antenna element being arranged in a first region of four regions delimited by crossing lines virtually set within a single plane and the second L-shaped dipole antenna element being arranged in a second region thereof which is diagonally opposite to the first region, and the first bending portion of the first L-shaped dipole antenna element and the second bending portion of the second L-shaped dipole antenna element being close and opposite to each other such that the first and second L-shaped dipole antenna elements form a cross; and a parallel-twin-line feeder extended from the first and second bending portions of the first and second L-shaped dipole antenna elements and provided so as to feed power within the single plane.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION (First Embodiment)

Figure 1:
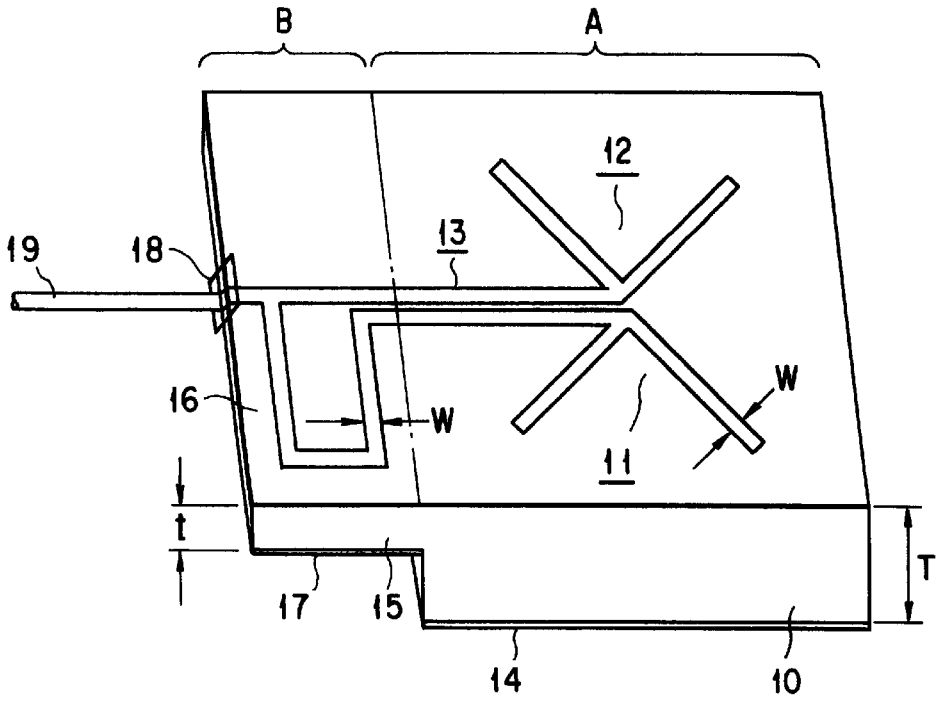
FIG. 1 is a perspective view illustrating a constitution of a circularly polarized cross dipole antenna according to a first embodiment of the present invention.

In FIG. 1, reference letter A indicates an antenna section and reference letter B does a balun section (a matching transformer for transforming a balanced line and an unbalanced line). The antenna section A is constituted by forming first and second L-shaped dipole antenna elements 11 and 12 and a parallel-twin-line feeder 13 on the surface of a block-shaped dielectric having a thickness T by lithography.

The antenna elements 11 and 12 are constituted of strip thin-film conductors each having a width W of about 0.5 mm, and the parallel-twin-line feeder 13 is formed of two parallel lines connected at one end to their respective bending portions of the first and second antenna elements 11 and 12. The first and second antenna elements 11 and 12 radiate a radio wave in the main radiation direction (in an upward direction in FIG. 1) and in its opposite direction (in a downward direction in FIG. 1). A reflector 14 is adhered onto the underside of the dielectric 10 to reflect the radio wave radiated from the antenna elements 11 and 12 in the opposite direction and combine it with a radio wave radiated therefrom in the main radiating direction.

The balun section B is constituted by forming a matching wiring section 16 of a strip thin-film conductor having a width W of about 0.5 mm on the surface of a block-shaped dielectric 15 having a thickness t which is smaller than that of the dielectric 10 by lithography. A reflector 17 is adhered onto the underside of the dielectric 15. One end of the matching wiring section 16 is connected to the twin-line feeder 13, and the other end thereof is connected to a coaxial line 19 through a connector 18.

In order to assemble the above-described antenna, the dielectrics 10 and 15 are formed integrally as one component, and the first and second L-shaped dipole antenna elements 11 and 12, parallel-twin-line feeder 13 and matching wiring section 16 are processed at the same time.

Figure 2:
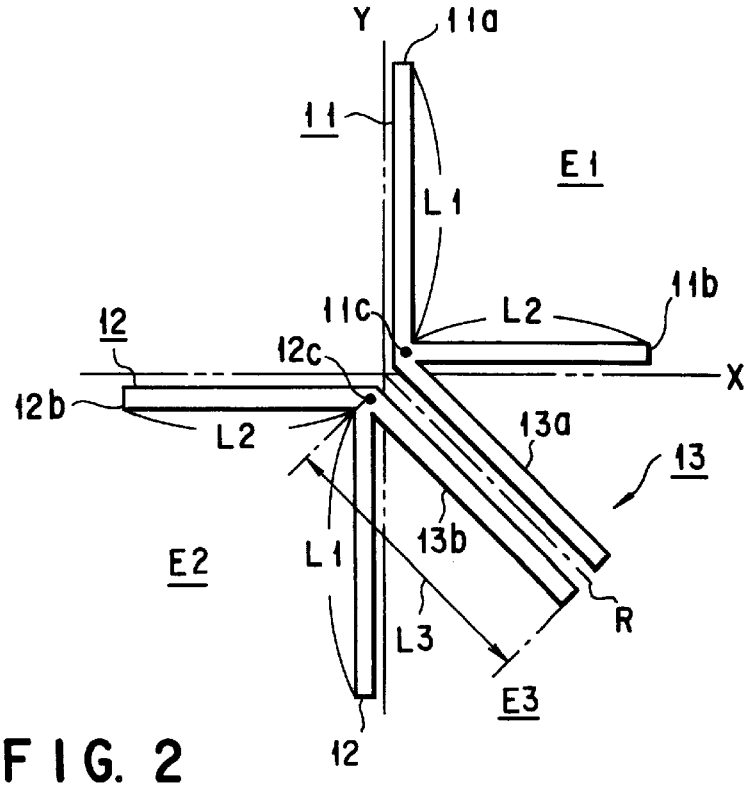
FIG. 2 is a plan view of antenna elements of the circularly polarized cross dipole antenna illustrated in FIG. 1.

As illustrated in FIG. 2, the first and second L-shaped dipole antenna elements 11 and 12 are arranged in two of four regions delimited by two virtual crossing lines X and Y (two lines crossing each other at right angles in the first embodiment) within a single plane on the dielectric 10 or a first region E1 and a second region E2 which are diagonally opposite to each other.

The first L-shaped dipole antenna element 11 in the first region E1 is obtained by bending a pair of strip conductors 11*a* and 11*b* having different lengths L1 and L2. The conductor 11*a* having a length L1 is formed along the line Y, while the conductor 11*b* having a length L2 is formed along the line X.

The second L-shaped dipole antenna element 12 in the second region E2 is obtained by bending a pair of strip conductors 12*a* and 12*b* having different lengths L1 and L2. The conductor 12*a* having a length L1 is formed along the line Y, while the conductor 12*b* having a length L2 is formed along the line X.

The first and second L-shaped dipole antenna elements 11 and 12 have bending portions 11*c* and 12*c*, and these portions are close and opposed to each other such that the pair of strip conductors 11*a* and 11*b* and the pair of strip conductors 12*a* and 12*b* form a cross.

The conductor 11*a* of the first antenna element 11 and the conductor 12*a* of the second antenna element 12, which are formed along the line Y, have the same length L1. The conductor 11*b* of the first antenna element 11 and the conductor 12*b* of the second antenna element 12 have the same length L2. The length L1 is larger than the length L2 (L1>L2). The ratio of L1 to L2 (L1/L2) is set to 1.3 to 1.5. If the ratio is 1.0 or more, the radiated circularly polarized wave is a right-handed polarized wave, and if the ratio is less than 1.0, it is a left-handed polarized wave.

The parallel-twin-line feeder 13 is constituted of a pair of conductors 13*c* and 13*b* which are extended from the bending portions 11*c* and 12*c* of the first and second antenna elements 11 and 12 into a third region E3 delimited by the crossing lines X and Y and interposed between the first and second regions E1 and E2. The conductors 13*c* and 13*b* have the same length L3.

The feeder 13 feeds power to the first and second antenna elements 11 and 12 within the same plane including these antenna elements.

The conductors 13*c* and 13*b* of the feeder 13 are arranged in parallel with a line R extending halfway between the crossing lines X and Y (at a 45° angle from the crossing lines X and Y).

Figure 3:
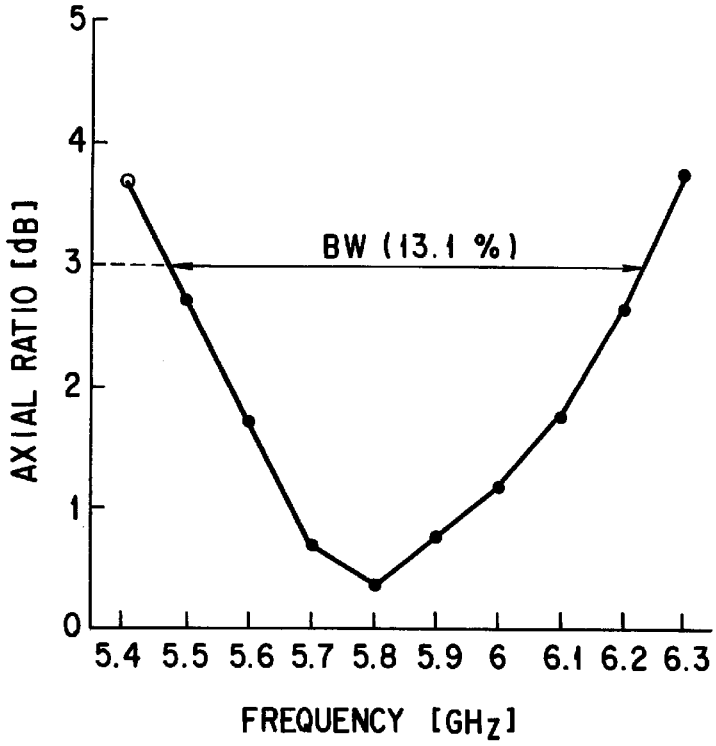
FIG. 3 is an axial-ratio/frequency-characteristic diagram showing measured results of antenna characteristics of the circularly polarized cross dipole antenna illustrated in FIG. 1.
Figure 4:
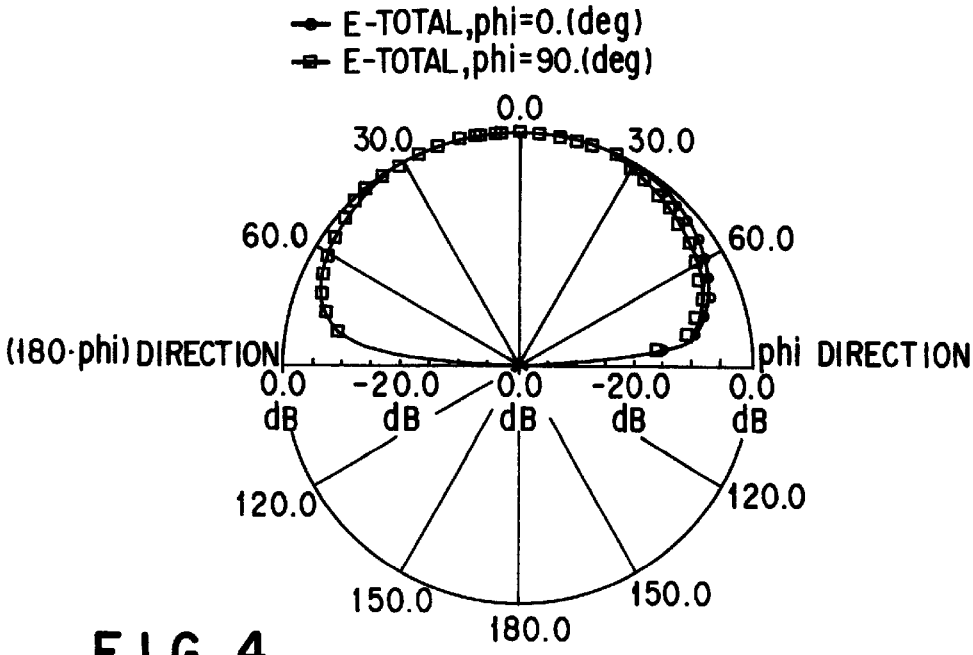
FIG. 4 is a radiation pattern view showing measured results of antenna characteristics of the circularly polarized cross dipole antenna illustrated in FIG. 1.

FIGS. 3 and 4 show antenna characteristics of the circularly polarized cross dipole antenna according to the first embodiment. FIG. 3 is an axial-ratio/frequency-characteristic diagram, and FIG. 4 is a radiation pattern (directivity) view. The antenna characteristics are measured under the following conditions:

CONDITIONS

1) Section to be measured: Only antenna section A (excluding balun section B)

2) Thickness of dielectric 10: T=8 mm

3) Dielectric constant of dielectric 10: $\epsilon$=2.84

4) Length of each conductor of antenna elements: L1=9.9 mm and L2=7.5 mm 5) Length of feeder 13: L3=8.48 mm 6) Width of each conductor: W=0.5 mm 7) Input impedance measured at connector 18: Z=(230+j226.5)Ω

RESULTS

The input impedance is somewhat high, but FIG. 3 shows that the bandwidth BW is 13.1% when the axial-ratio is 3 dB. This is 2.6 times as broad as a normal bandwidth of about 5% when the ratio is 3 dB and thus the antenna of the first embodiment can be said to have a considerably broad bandwidth characteristic. The radiation pattern shown in FIG. 4 exhibits good characteristics free from distortion. This means that though the feeder 13 is formed within the same plane including the first and second L-shaped dipole antenna elements 11 and 12, the directivity of the antenna is not inferior to that of a prior art antenna in which a feeder is formed at right angles with a plane including antenna elements.

As is evident from the above, the circularly polarized cross dipole antenna of the first embodiment has the advantage that it has a flat structure favorable for being mounted on a circuit board and the parallel-twin-line feeder 13 not only feeds electric power but also serves as a radiation element for improving antenna characteristics. Consequently, the antenna can easily be mounted on a circuit board, and it does not have any problems in antenna characteristics, or rather exceeds a prior art antenna in characteristics.

(Second Embodiment)

Figure 5:
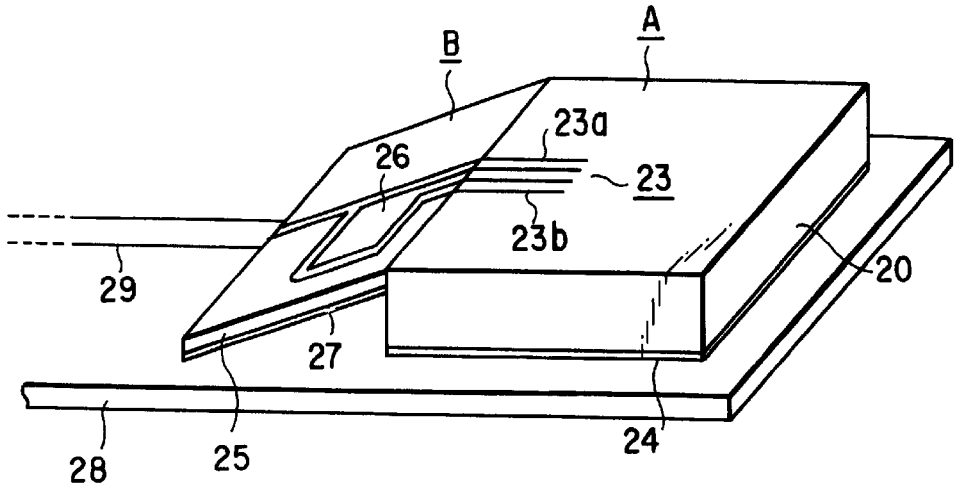
FIG. 5 is a perspective view illustrating a constitution of a circularly polarized cross dipole antenna according to a second embodiment of the present invention.

FIG. 5 is a perspective view illustrating a constitution of a circularly polarized cross dipole antenna according to a second embodiment of the present invention. As shown therein, a balun section B is tilted on a circuit board 28. More specifically, one end of a dielectric 25 of the balun section B is bonded to the upper edge of one end of a dielectric 20 of an antenna section A, and the other end thereof is bonded to the surface of the circuit board 28. Thus, one end of a matching wiring section 26 of the balun section B can be processed simultaneously with a feeder 23 (23*a*, 23*b*) of the antenna section A, and the other end thereof can directly be connected to a connection line 29 formed on the circuit board 28 not through a special connector but through a connection means such as solder. In FIG. 5, reference numerals 24 and 27 each indicate a reflector.

The circularly polarized cross dipole antenna of the second embodiment can be mounted on the circuit board 28 more easily than that of the first embodiment.

(Third Embodiment)

Figure 6:
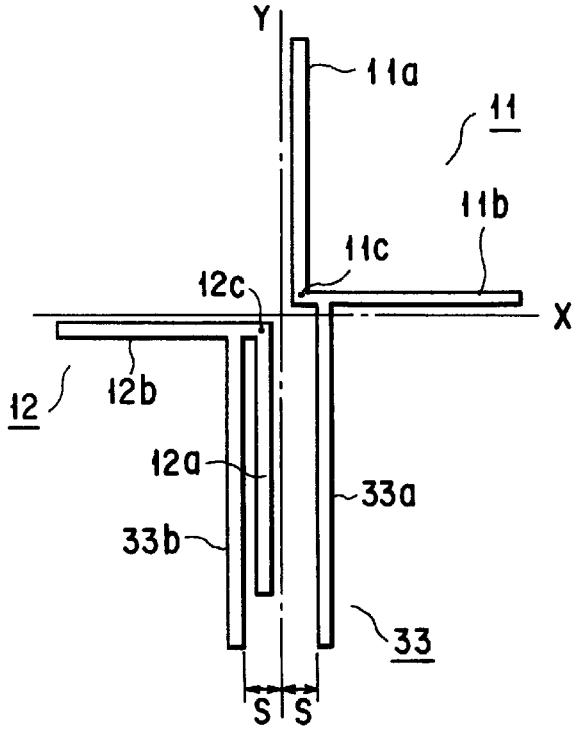
FIG. 6 is a plan view of antenna elements of a circularly polarized cross dipole antenna according to a third embodiment of the present invention.
Figure 7:
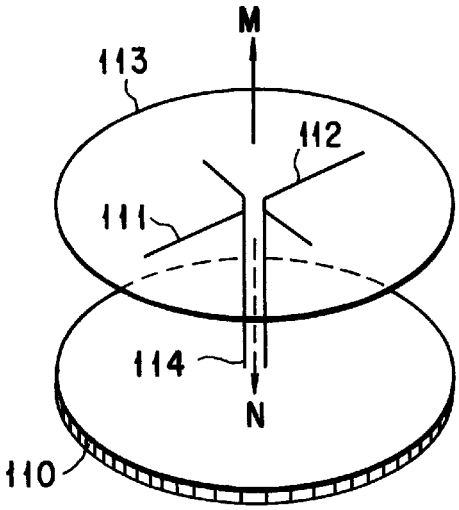
FIG. 7 (PRIOR ART)
FIG. 7 is a perspective view showing an example of a prior art circularly polarized cross dipole antenna.

FIG. 6 is a plan view of antenna elements of a circularly polarized cross dipole antenna according to a third embodiment of the present invention. Referring to FIG. 6, a feeder 33 is constituted of a pair of conductors 33*a* and 33*b*, and these conductors extend on both sides of and in parallel with one conductor 12*a* of a second L-shaped dipole antenna element 12.

One end of the conductor 33*a* is connected to a portion near to a bending portion 11*c* of a first L-shaped dipole antenna element 11 and the other end thereof extends in parallel with the conductor 12*a* outside the second antenna element 12 (on the right-hand side thereof in FIG. 6). One end of the conductor 33*b* is connected to a portion near to a bending portion 12*c* of the second antenna element 12 and the other end thereof extends in parallel with the conductor 12*a* inside the second antenna element 12 (on the left-hand side thereof in FIG. 6). The paired conductors 33*a* and 33*b* of the feeder 13 are located at an equal distance S from the line Y.

In the third embodiment, too, substantially the same advantage as that of the first embodiment can be expected.

(Features of the Embodiments)

[1] A circularly polarized cross dipole antenna is featured by comprising a first L-shaped dipole antenna element (11) including a first pair of strip conductors (11*a*, 11*b*) and a first bending portion (11*c*) and a second L-shaped dipole antenna element (12) including a second pair of strip conductors (12*a*, 12*b*) and a second bending portion (12*c*). The first L-shaped dipole antenna element (11) is arranged in a first region (E1) of four regions delimited by crossing lines (X, Y) virtually set within a single plane, and the second L-shaped dipole antenna element (12) is arranged in a second region (E2) thereof which is diagonally opposite to the first region (E1). The first bending portion (11*c*) of the first L-shaped dipole antenna element (11) and the second bending portion (12*c*) of the second L-shaped dipole antenna element (12) are close and opposite to each other such that the first and second L-shaped dipole antenna elements (11, 12) form a cross. The antenna also comprises a parallel-twin-line feeder (13) extended from the first and second bending portions (11*c*, 12*c*) of the first and second L-shaped dipole antenna elements (11, 12) and provided so as to feed power within the single plane.

In the circularly polarized cross dipole antenna described above, since the parallel-twin-line feeder (13) is provided so as to feed power within the same plane as that including the first and second L-shaped dipole antenna elements (11, 12), it also radiates a radio wave, and the radio wave is combined with radio waves of the first and second L-shaped dipole antenna elements (11, 12) to excite a circularly polarized wave. In this case, the current distribution exhibits a complicated aspect, but it is seen that a frequency bandwidth in an axial ratio is broaden and good antenna characteristics are obtained. The circularly polarized cross dipole antenna has a flat structure in which the first and second L-shaped dipole antenna elements (11, 12) and feeder (13) are arranged within the same plane and easily mounted on a circuit board, and its antenna characteristics are considerably satisfactory.

[2] In a circularly polarized cross dipole antenna described in above item [1], the parallel-twin-line feeder (13) is extended from the first and second bending portions (11*c*, 12*c*) into a third region (E3) of the four regions delimited by the crossing lines (X, Y), which is located between the first region (E1) and the second region (E2), and the parallel-twin-line feeder is formed of a pair of conductors (13*a*, 13*b*) provided along a line (R) extending halfway between the crossing lines (X, Y).

The above circularly polarized cross dipole antenna is easy to assemble since a region for arranging the feeder (13) can be secured easily and exactly. Moreover, the antenna characteristics is easy to stabilize since an influence of the first and second L-shaped dipole antenna elements (11, 12) is equalized.

[3] In a circularly polarized cross dipole antenna described in above item [1], the parallel-twin-line feeder (13) is formed of a pair of conductors (13*a*, 13*b*) arranged in parallel with one of the strip conductors (11*a*, 11*b*, 12*a*, 12*b*) of the first and second L-shaped dipole antenna elements (11, 12).

In the foregoing circularly polarized cross dipole antenna, the strip conductors (13*a*, 13*b*) of the feeder (13) can be arranged to have a pattern as described above, depending on the mounting conditions. If, therefore, the above pattern of the strip conductors is adopted according to the circumstances, a connecting portion thereof can be simplified.

[4] A circularly polarized cross dipole antenna described in above item [1] further comprises a reflector (14) provided in parallel with and at a predetermined distance from the first and second L-shaped dipole antenna elements (11, 12) in a direction opposite to a main radiating direction of the first and second L-shaped dipole antenna elements (11, 12).

Since the circularly polarized cross dipole antenna comprises the reflector (14), its antenna characteristics are greatly improved.

[5] In a circularly polarized cross dipole antenna described in above item [1], the parallel-twin-line feeder (23) is connected to a balun section (B) having a matching wiring section (26).

[6] In a circularly polarized cross dipole antenna described in above item [5], the balun section (B) is tilted such that one end of the matching wiring section (26) is connected to one end of the parallel-twin-line feeder (23) and the other end thereof is connected to a connection line (29) formed within a second plane other than a first plane including the parallel-twin-line feeder (23).

The above circularly polarized cross dipole antenna can be mounted on a circuit board (28) more easily since the feeder (23) is smoothly connected to the connection line (29) not using any special connectors but through the balun section (B).

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A circularly polarized cross dipole antenna comprising:

a first L-shaped dipole antenna element including a first pair of strip conductors and a first bending portion, and a second L-shaped dipole antenna element including a second pair of strip conductors and a second bending portion, the first L-shaped dipole antenna element being arranged in a first region of four regions delimited by crossing lines virtually set within a single plane and the second L-shaped dipole antenna element being arranged in a second region thereof which is diagonally opposite to the first region, and the first bending portion of the first L-shaped dipole antenna element and the second bending portion of the second L-shaped dipole antenna element being close and opposite to each other such that the first and second L-shaped dipole antenna elements form a cross; and a parallel-twin-line feeder extended from the first and second bending portions of the first and second L-shaped dipole antenna elements and provided so as to feed power within the single plane.

2. A circularly polarized cross dipole antenna according to claim 1, wherein the parallel-twin-line feeder is extended from the first and second bending portions into a third region of the four regions delimited by the crossing lines, which is located between the first region and the second region, and the parallel-twin-line feeder is formed of a pair of conductors provided along a line extending halfway between the crossing lines.

3. A circularly polarized cross dipole antenna according to claim 1, wherein the parallel-twin-line feeder is formed of a pair of conductors arranged in parallel with one of the strip conductors of the first and second L-shaped dipole antenna elements.

4. A circularly polarized cross dipole antenna according to claim 1, further comprising a reflector provided in parallel with and at a predetermined distance from the first and second L-shaped dipole antenna elements in a direction opposite to a main radiating direction of the first and second L-shaped dipole antenna elements.

5. A circularly polarized cross dipole antenna according to claim 1, wherein the parallel-twin-line feeder is connected to a balun section having a matching wiring section.

6. A circularly polarized cross dipole antenna according to claim 5, wherein the balun section is tilted such that one end of the matching wiring section is connected to one end of the parallel-twin-line feeder and the other end thereof is connected to a connection line formed within a second plane other than a first plane including the parallel-twin-line feeder.

* * * * *